US006298997B1

(12) United States Patent
Jarrett et al.

(10) Patent No.: US 6,298,997 B1
(45) Date of Patent: Oct. 9, 2001

(54) STORAGE STATION

(75) Inventors: Blake Jarrett, Toronto (CA); David S. McCue, Marblehead, MA (US); Richard Collopy, Jr., Durham, NH (US); Allen Bowen, Beverly, MA (US)

(73) Assignee: McCue Corporation, Salem, MA (US)

( * ) Notice: Subject to any disclaimer, the term of this patent is extended or adjusted under 35 U.S.C. 154(b) by 0 days.

(21) Appl. No.: 09/412,658

(22) Filed: Oct. 5, 1999

Related U.S. Application Data

(63) Continuation-in-part of application No. 09/070,553, filed on Apr. 30, 1998, now abandoned.

(51) Int. Cl.[7] ..... A47F 10/04
(52) U.S. Cl. ..... 211/17; 211/22
(58) Field of Search ..... 211/17, 22

(56) References Cited

U.S. PATENT DOCUMENTS

| | | | | |
|---|---|---|---|---|
| D. 321,798 | | 11/1991 | Buckley | D6/462 |
| D. 334,301 | | 3/1993 | Buckley | D6/462 |
| D. 350,038 | | 8/1994 | Buckley | D6/462 |
| D. 361,448 | | 8/1995 | Buckley | D6/462 |
| D. 376,854 | * | 12/1996 | DiPaolo et al. | D25/18 |
| 1,927,997 | | 9/1933 | Weston | 211/71 |
| 3,950,873 | | 4/1976 | Stehle et al. | 256/64 X |
| 4,236,697 | | 12/1980 | Savino | 256/1 |
| 4,528,974 | | 7/1985 | Nakamura et al. | 126/202 |
| 4,609,183 | | 9/1986 | Ulmer | 256/1 |
| 5,161,784 | | 11/1992 | Sader | 256/24 |
| 5,184,562 | * | 2/1993 | Hallin | 114/219 |
| 5,201,426 | | 4/1993 | Cruwell, Jr. | 211/17 |
| 5,279,085 | | 1/1994 | DiPaolo et al. | 52/169.2 |
| 5,551,578 | | 9/1996 | McCue et al. | 211/17 |
| 5,891,534 | * | 4/1999 | Sabin et al. | 428/11 |

* cited by examiner

*Primary Examiner*—Daniel P. Stodola
*Assistant Examiner*—Erica B. Harris
(74) *Attorney, Agent, or Firm*—Lahive & Cockfield, LLP

(57) ABSTRACT

A shopping cart storage station for installation in a parking lot or other large area has an end frame and a first elongate side wall assembly connected to the end structure's first side leg, and a second elongate side wall assembly connected to the end structure's second side leg. A plastic bumper panel is mounted on each of the first and second side wall metal frames for minimizing damage caused by impact with a moving object. Upwardly projecting frames are located at the front of the station, coplanar with each bumper. The upwardly projecting frames bear signs at the top, and are joined by an overhead front cross bar.

4 Claims, 10 Drawing Sheets

STORAGE STATION

This application is a continuation-in-part of Ser. No. 09/070,553, now abandoned filed Apr. 30, 1998; now abandoned.

BACKGROUND OF THE INVENTION

Shopping cart control and storage is a problem in the parking lots of many shopping areas. The problem stems from customers abandoning carts after they have taken the carts from the store to their vehicles for unloading. To avoid damage to customer's vehicles and to the shopping carts themselves, as well as to prevent clogging of parking spaces and thoroughfares, it has become common practice to provide cart corrals or storage areas spaced throughout the parking lot in an effort to encourage customers to return the carts. Store employees or customers on their way into the store can then retrieve the carts from these storage areas.

The cart corrals commonly in use are, as the name implies, primarily all metal, fence-like structures. The metal from which cart corrals are typically made has a number of drawbacks. It is likely to rust and deteriorate, limiting the useful life of the corral and discouraging patrons from using it by its unattractiveness and potential to damage clothing. In the event that a car door is opened into a metal corral, both the car and the corral are likely to be damaged. Visibility of such open, fence-like structures is low, which further deters customers from using them.

Cart corrals as presently constructed are often permanently installed in parking lots. In areas of the country where snow is common, such open corrals may go unplowed, preventing customers from employing them. In other cases, cart corrals may be left freestanding, subject to movement by shifting weather patterns or accidental collisions.

One alternative to metal cart storage stations is taught in U.S. Pat. No. 5,551,578 issued to McCue et al., incorporated herein by reference. However, a lower cost, colorful and highly visible, rust and scratch resistant cart storage station is needed.

It is therefore a primary object of the present invention to provide an improved storage facility for controlling shopping carts in a parking lot or large area. It is a further object of the present invention to provide an improved storage facility for other objects such as luggage, stock carts, and warehouse carts. Other objects and advantages of the present invention reside in the provision of an improved, protected storage area for shopping carts which is economical to manufacture, and easy to ship and install. The present invention has further advantages in that it is non-destructive, highly visible, durable in use, and attractive to the customer.

SUMMARY OF THE INVENTION

The present invention is directed to a shopping cart storage station for installation in a parking lot or other large area. The storage station has an end structure including first and second side legs. The storage station includes a first elongate side wall assembly connected to the first side leg, and a second parallel elongate side wall assembly connected to the second side leg. The storage station further includes a bumper panel mounted on a side wall assembly for minimizing damage caused by impact with an object. Examples of an object that could impact the storage station include a car, a car door, or a shopping cart. The first and second side wall assemblies are spaced apart a distance sufficient to store a shopping cart.

Optionally, the storage station can include one or more signs to improve visibility, or the storage station can include a roof to protect the stored objects from rain or snow, and to prevent snow accumulation. The storage station can also be fitted with shielding panels above, between, or against the bumper panel members. Such shielding panels can be clear or opaque and are useful for posting instructions or advertising, and as a weather shield.

Preferably, the elongate side wall assembly comprises a metal frame and a non-metallic bumper panel mounted on the metal frame, constituting a substantial portion of the assembly. In preferred embodiments, an overhead front cross bar connects the side assemblies, extending from first and second upright frames extending upwardly from, and co-planar with, the first and second side wall assemblies. Further, at least one of the upright frames has an upper section adapted to mount a sign.

The bumper panel is preferably constructed of a substantially rigid plastic, which may be molded, recycled, composite, or fiber-reinforced plastic. Particularly preferred materials include molded polyethylene and fiberglass. This construction thereby avoids the disadvantages of previous cart corrals in that the bumper panel members, and hence the entire storage station, are highly visible, do not rust, and are not likely to cause damage to a vehicle or other object upon impact. Moreover, the storage station is highly stable, yet will "give" or flex if inadvertently bumped by a car or a shopping cart. Thus, the bumper panel members absorb the force of impact with an object, preventing damage to the storage station itself and to the object, such as a car or a shopping cart. Thus, the present invention provides a low cost, colorful and highly visible, rust and scratch resistant storage station.

Novel features which are considered to be characteristic of the invention are set forth with particularity in the appended claims. For a fuller understanding of the nature and objects of the invention, reference should be made to the following detailed description taken in connection with the accompanying drawings, in which it will be seen that the objects set forth above, including those made apparent from the preceding description, are efficiently attained. Since certain changes may be made in the above construction without departing from the scope of the invention, it is intended that all matter contained in the above description or shown in the accompanying drawings shall be interpreted as illustrative and not in a limiting sense.

DETAILED DESCRIPTION

Figure 1:
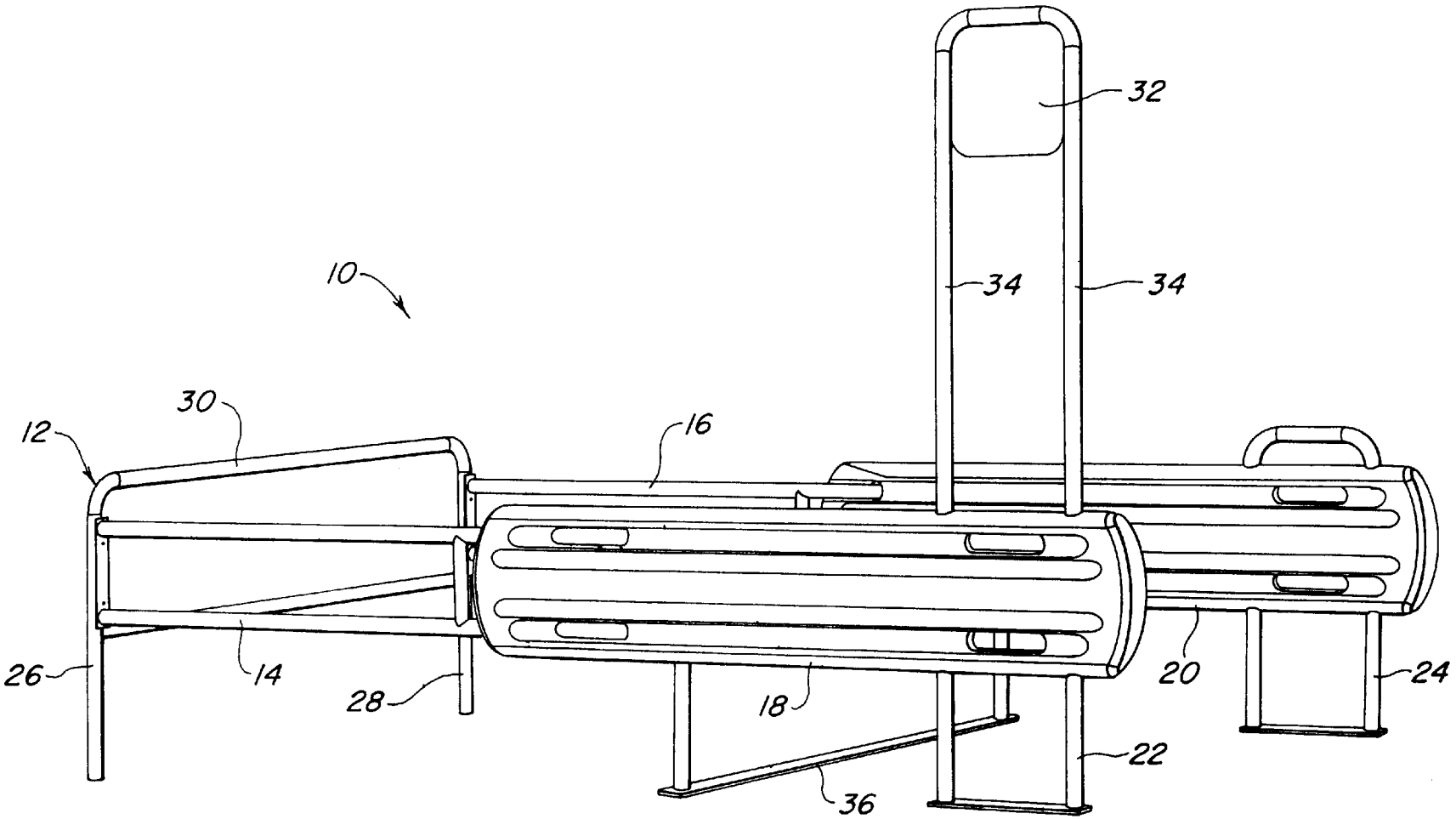
FIG. 1 is a perspective view of a storage station according to one embodiment of the present invention.

Referring to the Figures of the drawings, wherein like reference numerals designate corresponding parts, FIG. 1 illustrates a storage station 10 having an end structure 12 including a connecting assembly 30 and first and second side legs 26, 28. The storage station 10 includes a first elongate side wall assembly 14 connected to the end structure first side leg 26 and a second elongate side wall assembly 16 connected to the end structure second side leg 28. The storage station 10 further includes at least one bumper panel member 18 mounted on one of the first and second side wall assemblies 14, 16. In a preferred embodiment, the storage station 10 includes first and second bumper panel members 18, 20 mounted on the first and second side wall assemblies, respectively. The storage station 10 can include uprights 34 and a locating panel 32. The storage station 10 can be secured to the surface by means known in the art such as by being staked into a parking lot or other large area, or the storage station can be left free standing.

The storage station 10 can further include a first substantially vertical side wall stub leg member for supporting the first side wall assembly 14, and a second substantially vertical side wall stub leg member for supporting the second side wall assembly 16. Alternatively, the storage station can include first and second side wall leg members 22, 24 that extend all or part of the way through first and second side bumper panel members 18, 20 respectively.

The height of an individual bumper panel member can be from 6" to 52", more preferably, from 12" to 48", and most preferably, from 24" to 42". The length of the bumper panel member can be from 2' to 15', more preferably, from 3' to 12', and most preferably, from 4' to 8'. The bumper panel member is preferably made from plastic. In a preferred embodiment, the bumper panel member is rotomolded from colorful polyethylene. The bumper panel member is mounted on the side wall assembly.

Connecting assembly 30 is formed of either a single unitary piece or multiple interconnected pieces, as in a linked chain. Furthermore, connecting assembly 30 can be either a rigid or flexible member. But in general, connecting assembly 30 includes an elongated member having at least two ends, each of which is secured to side legs 26, 28 by any means known in the art. In one embodiment, connecting assembly 30 is placed on top of side legs 26, 28 where it additionally serves as a stop bar for preventing stored objects from exiting the station. Connecting assembly 30, positioned as an end structure, can prevent first and second side wall assemblies 14, 16 from shifting or tipping over during installation or otherwise. This invention is not limited to the use of a single connecting assembly 30. Rather, the invention envisions multiple connecting members spanning side legs 26, 28, with each connecting member potentially serving different purposes, similar to the purposes described above. For example, connecting assembly 30 can also be attached to the bottom surface of side legs 26, 28 where it acts as a threshold barrier for preventing stored objects from rolling out of the storage station. Another threshold barrier 36 in the forward portion of the unit, attached at the bottom of legs extending downwardly from the side wall assemblies 14, 16, prevents stored objects from rolling out of the station.

Figure 2:
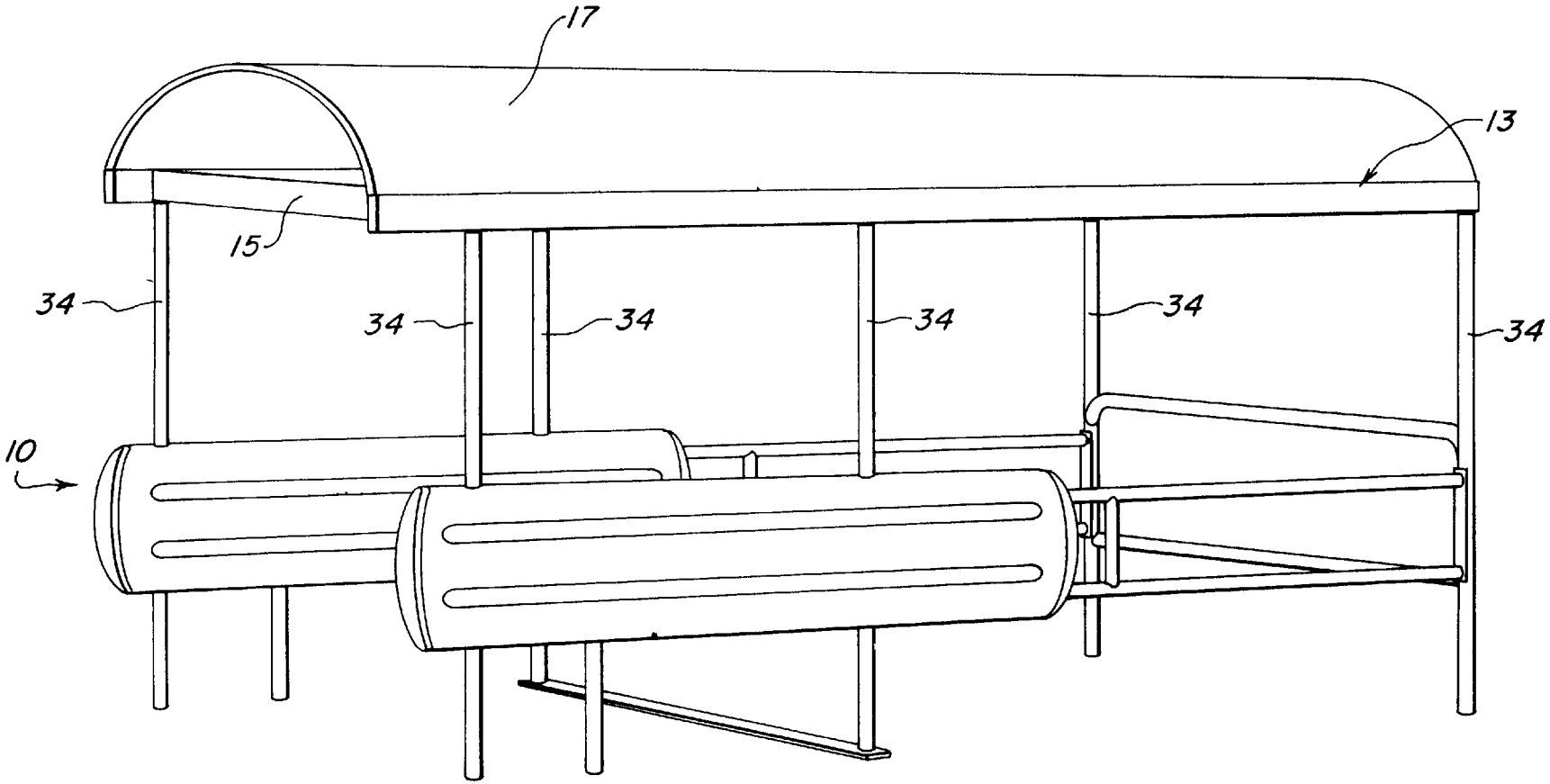
FIG. 2 is a perspective view of the storage station of FIG. 1 fitted with a roof.

As illustrated in FIG. 2, storage station 10 may be fitted with a roof structure 13, attached to uprights 34. In one embodiment, roof structure 13 includes cross-beams 15 and a spanning element 17. Roof structure 13 protects customers and stored objects from various environmental factors, including precipitation, wind, and excessive sun. Spanning element 17 may be clear or opaque, depending upon the amount of sunlight desired within storage station 10. Roof structure 13 may also serve as a place to attach posters and other means of communication.

Figure 3:
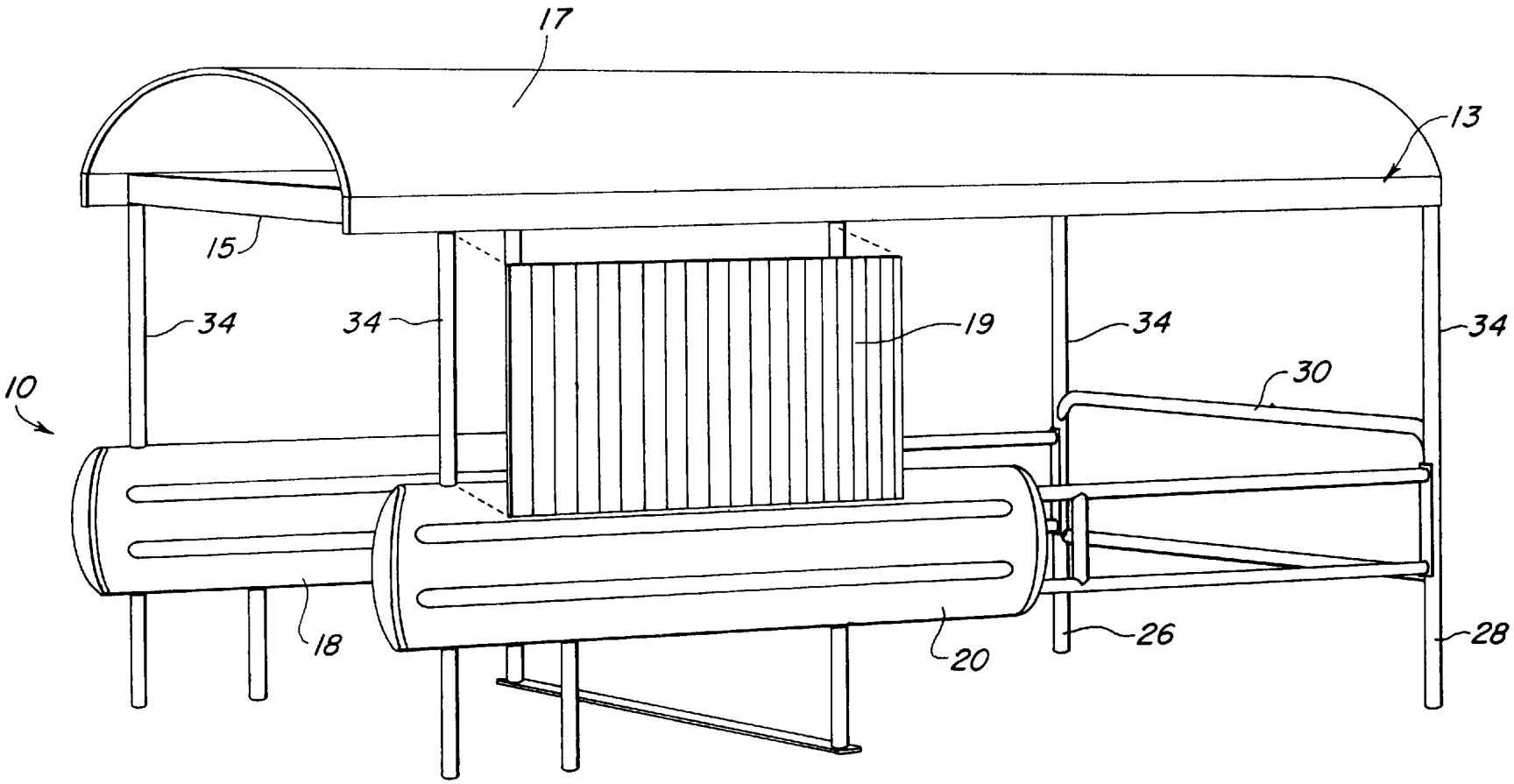
FIG. 3 is a perspective view of the storage station of FIG. 2 fitted with a panel.

FIG. 3 illustrates a storage station 10 having side legs 26, 28, uprights 34, connecting assembly 30 and shielding panel 19. Shielding panel 19 is secured to one or more uprights 34 in a substantially vertical position. The panel may either rest against the bumper panel 20 or it may be raised above the level of bumper panel 20. Shielding panel 19 protects the stored objects and customers within storage station 10 from environmental factors, including wind and precipitation, existing outside the storage station 10. Additionally, shielding panel 19 serves as a place to attach posters and other means of communication.

Figure 4:
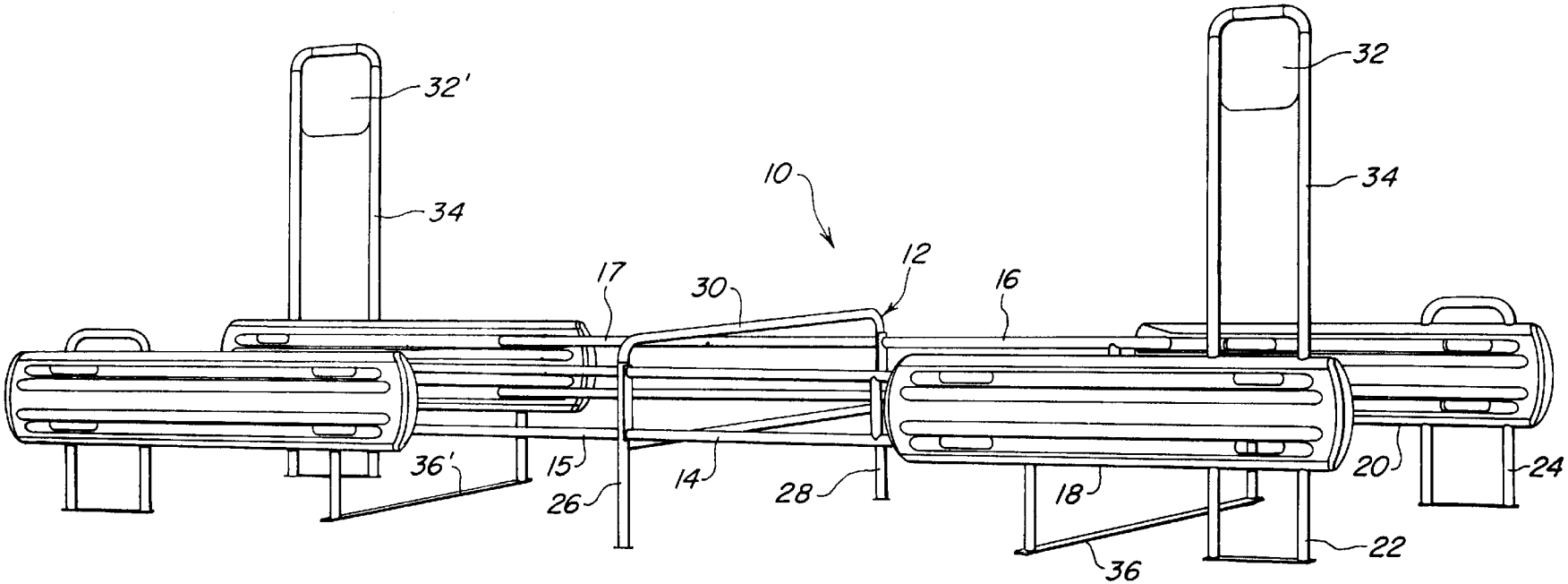
FIG. 4 is an alternative embodiment of the present invention showing a storage station having two connected corrals.

Storage stations of the present invention can include a single pair of side wall assemblies, as shown in FIG. 1, or they can include multiple pairs of side wall assemblies. FIG. 4 illustrates a storage station having two pairs of side wall assemblies 14, 16, and 15, 17. The illustrated embodiment of a storage station according to the invention 10 further includes an end structure 12, and two locating panels 32'. The end structure 12 secures both pairs of side wall assemblies. The two locating panels 32, 32' aid a customer in visibly locating the storage station. Alternatively, the storage station can have two pairs of side wall assemblies 14, 16 and 15, 17 without a connecting end structure.

Figure 5:
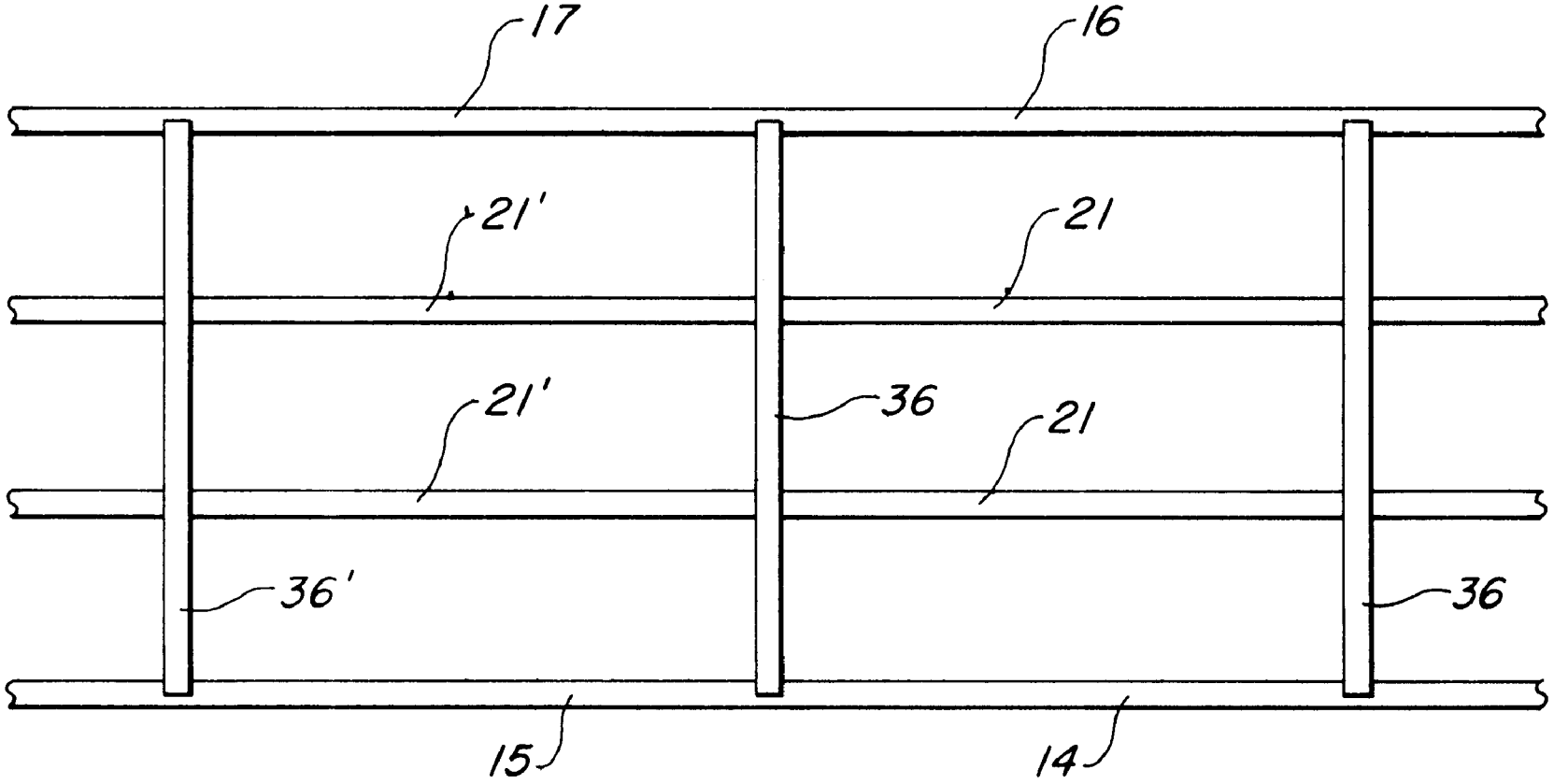
FIG. 5 is a top view of an alternative embodiment of the present invention showing a storage station having a width of three lanes with lane dividers.

The storage station according to the present invention can be configured in a variety of stored object widths, i.e., the distance between the first and second side wall assemblies can be a variety of stored object widths. For example, the distance between the first and second side wall assemblies can be 1, 2, or 3 stored object widths. Furthermore, the storage station can include stored object lane dividers 21, 21', as shown in FIG. 5. FIG. 5 is a top view of a storage station as shown in FIG. 4 having a width of three stored objects and with the addition of lane dividers. The lane dividers physically separate the stored objects into distinct lanes for a cleaner appearance. In a preferred embodiment, the stored objects are shopping carts. However, the stored objects can also be stock carts and warehouse carts.

Figure 6:
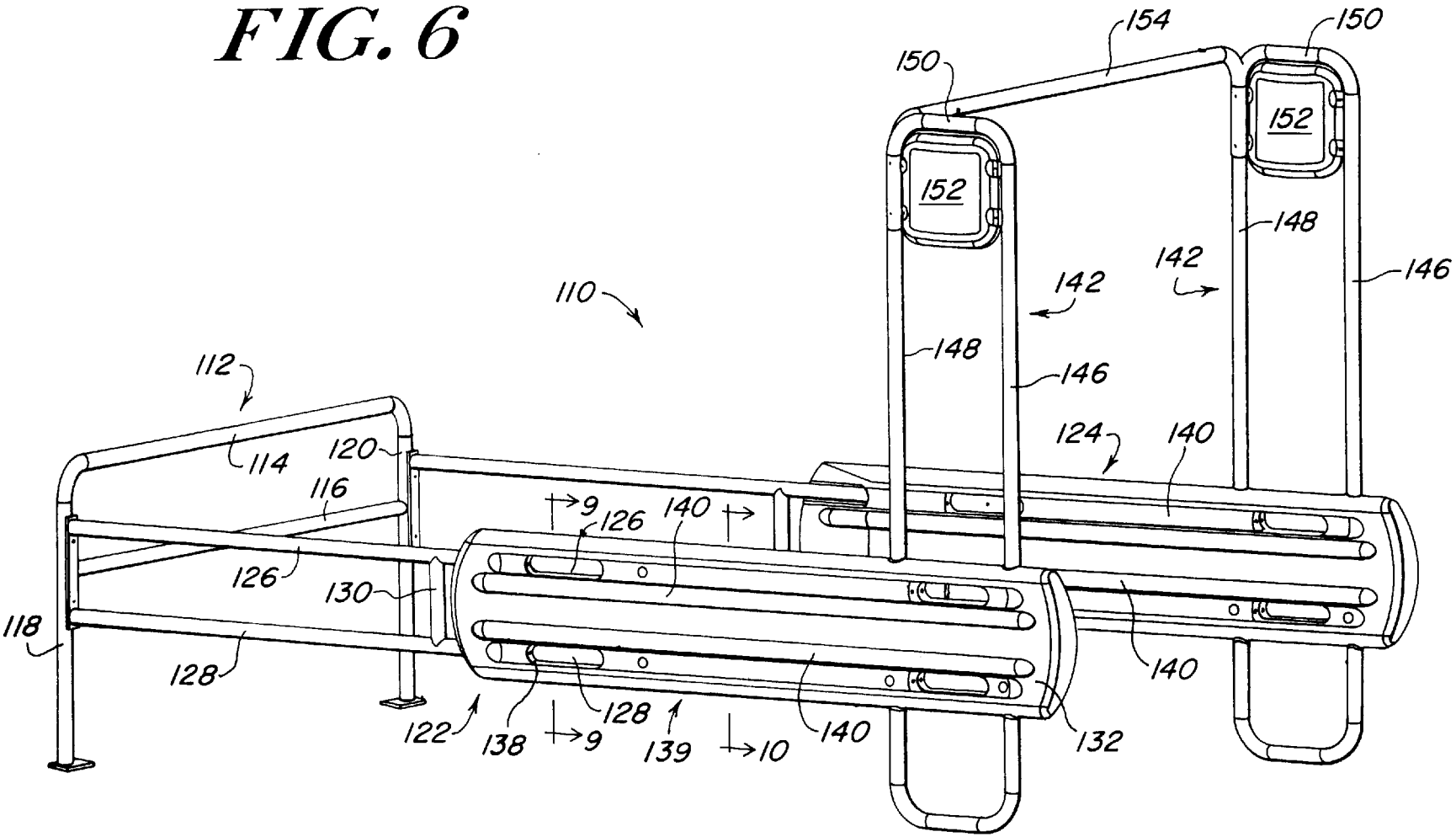
FIG. 6 is a perspective view of a storage station according to still another embodiment of the invention.
Figure 7:
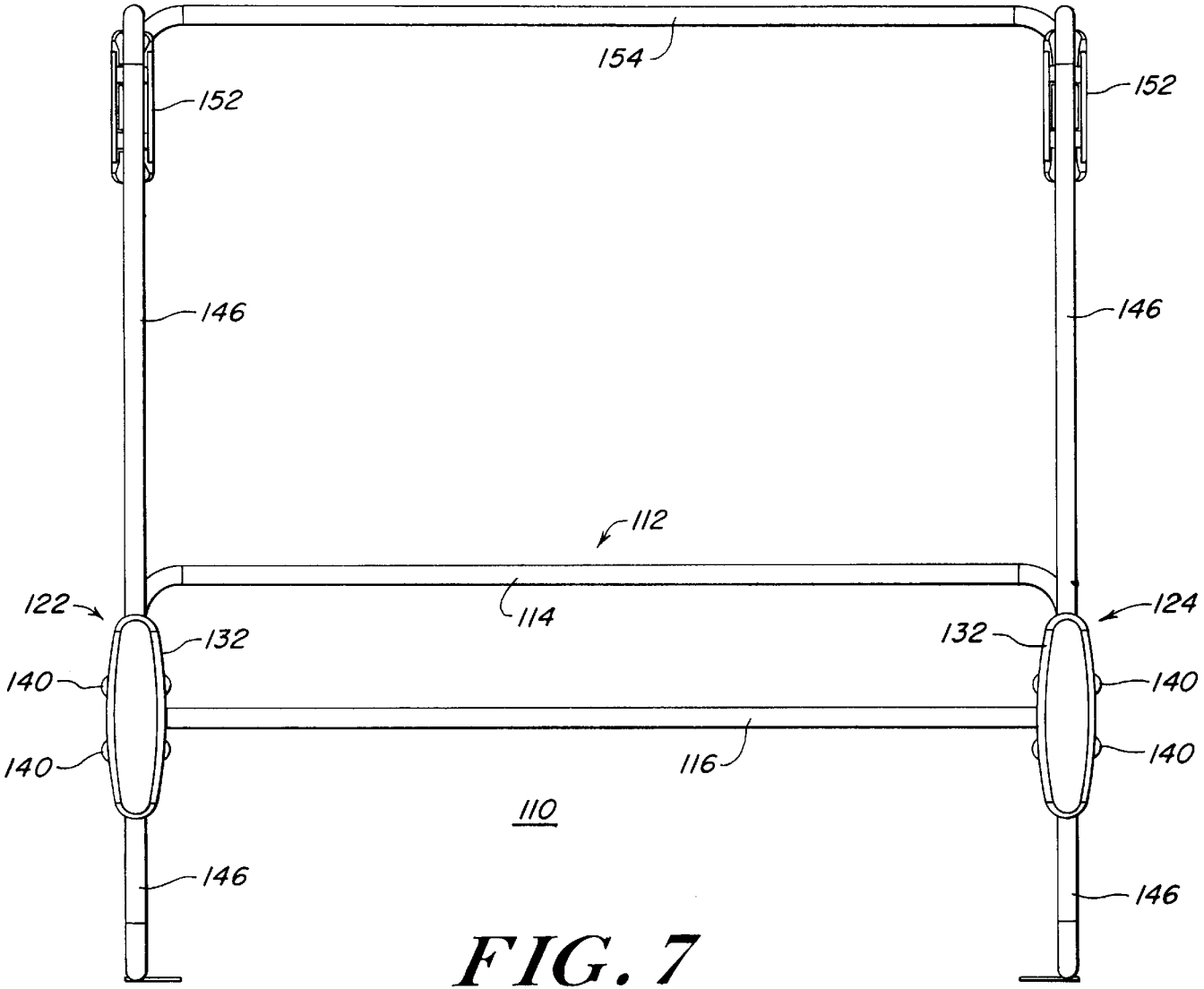
FIG. 7 is a front view of the embodiment shown in FIG. 6.
Figure 8:
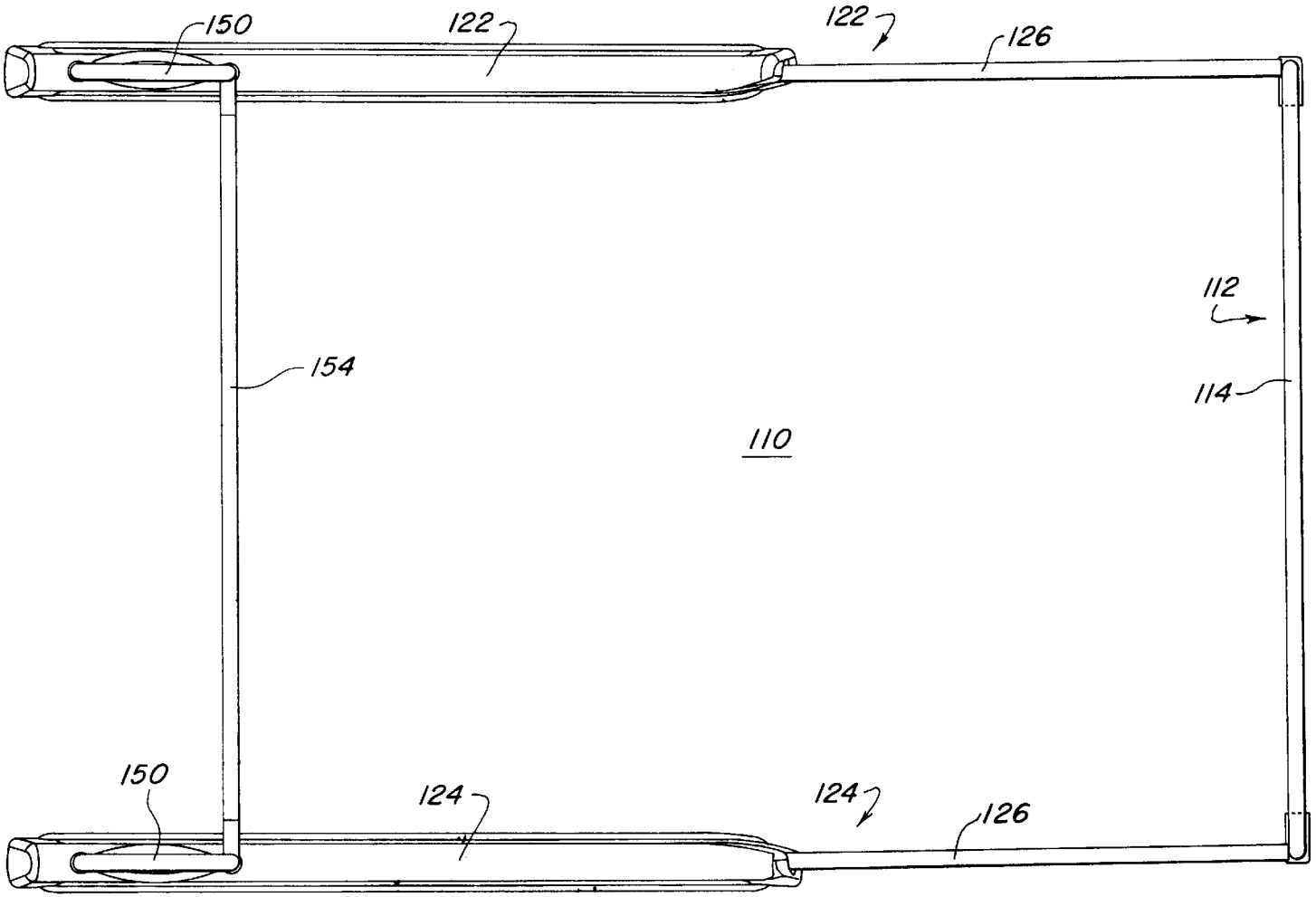
FIG. 8 is a plan view of the embodiment shown in FIG. 6.
Figure 9:
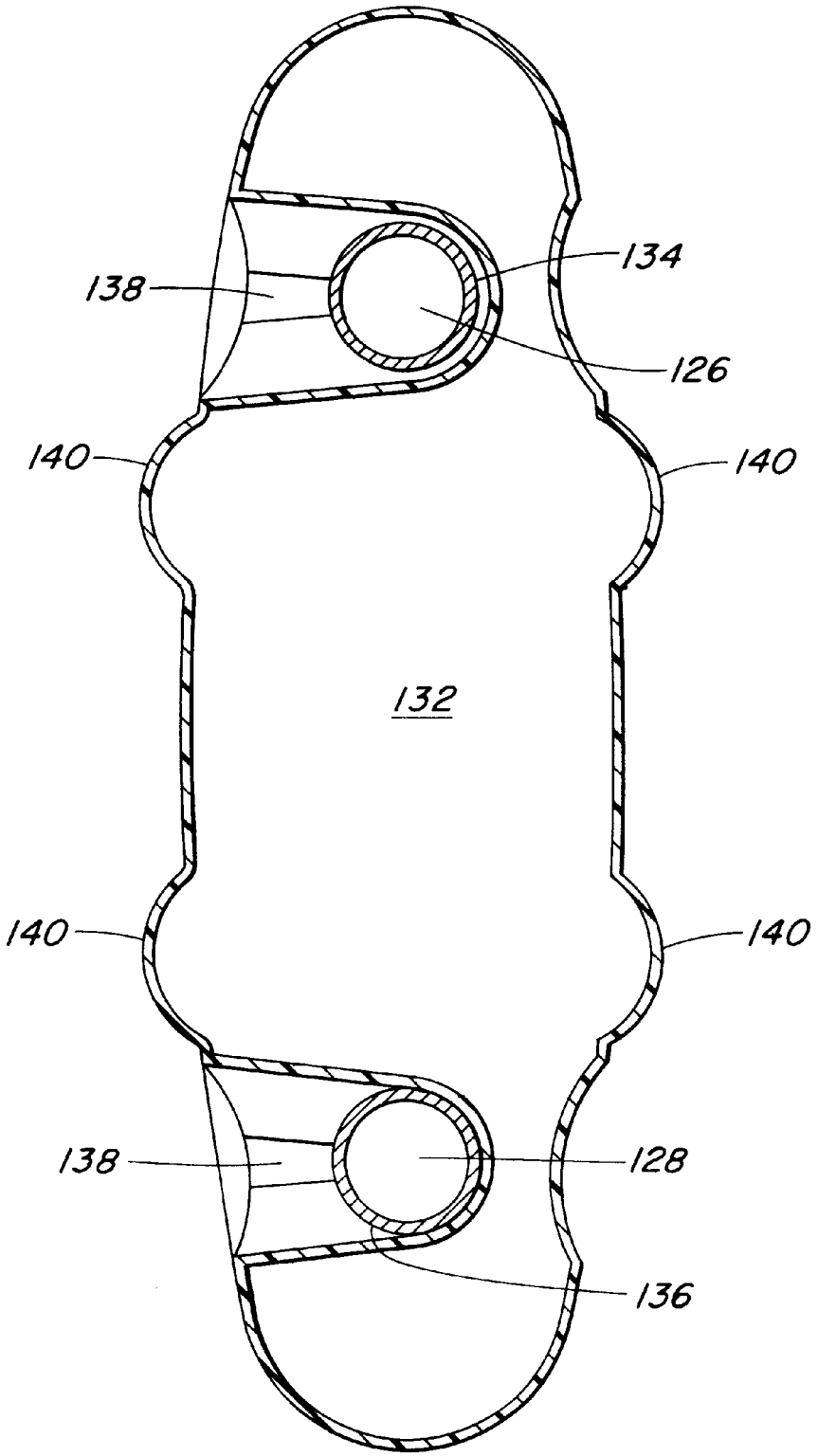
FIG. 9 is a sectional view of a side panel of the embodiment shown in FIG. 6 along the lines 9—9.
Figure 10:
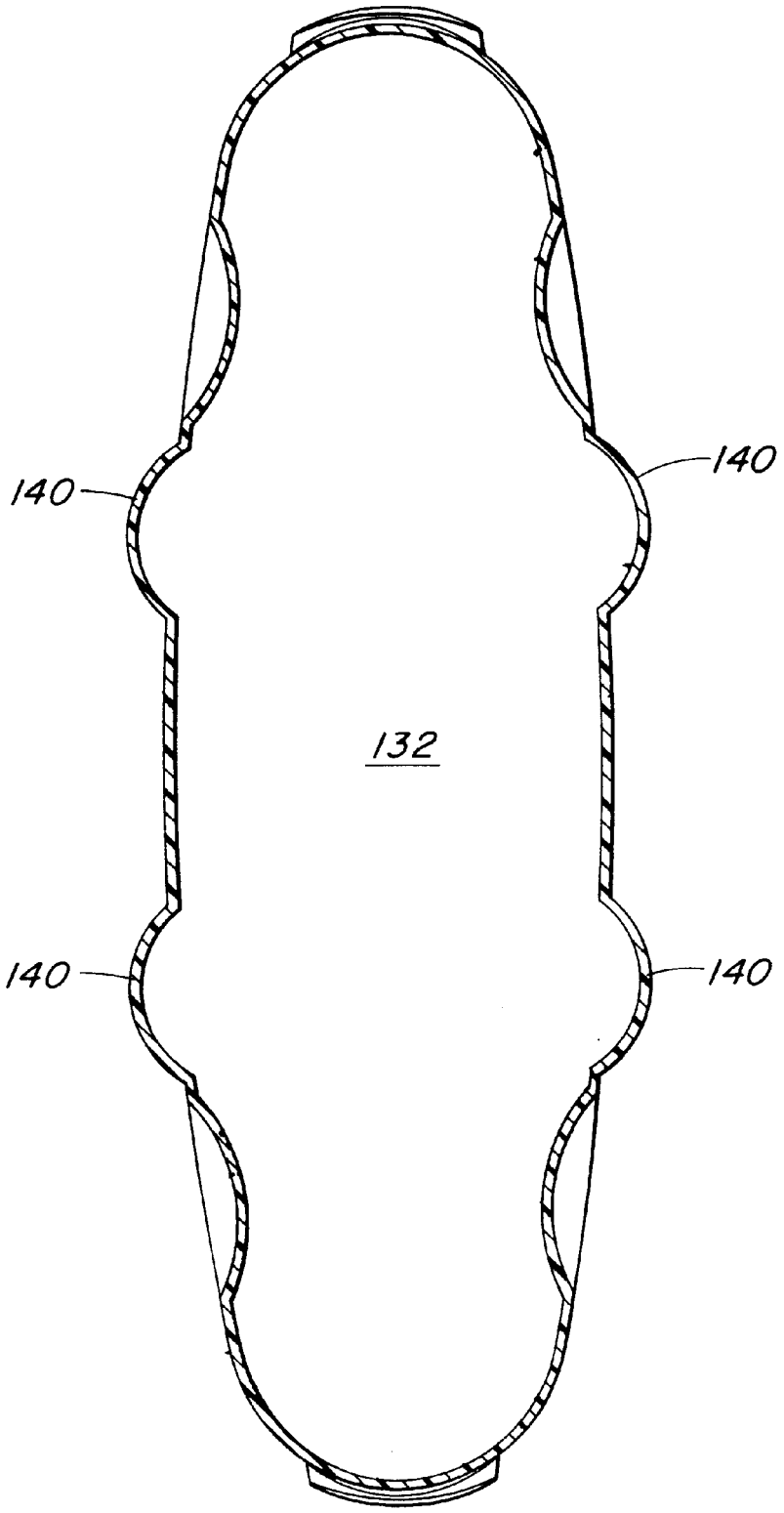
FIG. 10 is a sectional view of a side panel of the embodiment shown in FIG. 6 along the lines 10—10.

FIGS. 6–10 show still another embodiment of the invention. FIG. 6 is a perspective view of a storage station 110. The storage station includes an end vertical frame 112 having horizontal connecting bars 114 and 116 connected to vertical side legs 118 and 120.

A first elongate side wall frame 122 is connected to side leg 118 of the end frame 112 and extends along an axis perpendicular to the end frame 112. A second elongate side wall frame 124 is similarly connected to side leg 120 of the end frame 112 and similarly extends along an axis perpendicular to the end frame, so that it is parallel to, and spaced apart from, the first.

The first and second side wall frames 122, 124 are virtually mirror images of each other, so that the detailed description of the first side wall frame will apply to the second as well.

The station 110 consists primarily of tubular metal structural members, with plastic bumpers mounted on the frames 122, 124 and covering a substantial portion of them. The end vertical frame 112 is made up entirely of tubular metal structural members in the form of the upper and lower horizontal connecting bars 114, 116, and the vertical side legs 118, 120 to which they are connected.

The first side wall frame 122 includes a pair of horizontal, parallel, tubular, metal structural elements or beams 126, 128 attached to the end frame vertical leg 118, joined a distance from the end frame by a vertical reinforcing member 130, and extending into a relatively massive plastic bumper 132. The beams 126, 128 extend a distance into channels 134, 136 formed in the bumper 132, and are visible through slots 138 in the bumper 132, to give visual proof that they are fully inserted (see FIG. 9). The plastic bumper 132 provides a substantial portion of a first side wall assembly 139.

The bumper 132 is generally hollow, and oval in cross-section (see FIG. 10), with horizontally extending, parallel, cylindrical ribs 140 on both sides. The ribs 140 are formed to provide structural strength for the bumper 132, and to protrude enough to bear the brunt of impact from car doors and carts, so that the rest of the surface of the bumper 132 is left unmarred.

Near the front of the bumper 132, the side wall assembly 139 is supported by a tubular metal front frame 142. The front frame 142 has a bottom member 144 resting on the surface of the parking lot or area where the station 110 is located. The bottom member 144 is attached to vertically extending upright members 146, 148. The vertically extending upright members 146, 148 pass through holes in the plastic bumper 132 and extend well above the top of the bumper 132.

The upright members 146, 148 complete the metal frame 142 with a top member 150 that connects the two upright members 146, 148. A panel 152 is attached to the upper portion of the frame 142, parallel to it. Preferably the panel 152 bears signage indicating the presence of the cart station 110.

Both bumpers 132 have the metal frames 142 extending well above the top of the bumpers. There is, finally, a connecting overhead front cross bar 154 extending from the top of the frame above one bumper to the top of the frame above the other bumper, and connecting to both. The overhead front cross bar 154 adds rigidity to the structure of the station 110, and permits the omission of structural members extending along the ground from one side of the station to the other. Such structural members are usually desirable, for strengthening the station structure, but they can be an impediment to movement in and out of the station, and a safety hazard. The overhead front cross bar 154 strengthens the station structure but does it overhead, well above ground level.

Those skilled in the art will recognize, or be able to ascertain using no more than routine skill and knowledge, numerous equivalents to the specific elements described herein. Such equivalents are considered to be within the scope of this invention and are covered by the following claims. It is also to be understood that the following claims are intended to cover all of the generic and specific features of the invention, which, as a matter of language, might be said to fall there between.

What is claimed is:

1. A cart storage station comprising:

(a) an end vertical frame;

(b) a first elongate side wall frame connected to said end vertical frame and extending along an axis perpendicular to said end vertical frame;

(c) a second elongate side wall frame connected to said end vertical frame and extending parallel to and spaced apart from said first elongate side wall frame, said first and second elongate side wall frames defining a cart storage area between them;

(d) at least one non-metallic bumper panel mounted on one of said first and second elongate side wall frames and covering a substantial portion of said elongate side wall frame for absorbing impact from objects; and (e) an overhead front cross bar connecting said first and second elongate side wall frames, for preventing movement of said first elongate side wall frame relative to said second elongate side wall frame, whereby carts may be unimpeded in movement into said cart storage station.

2. The cart storage station of claim 1 further including:

a first upright frame extending upwardly from said first elongate side wall frame, a second upright frame extending upwardly from said second elongate side wall frame, said overhead front cross bar extending from said first upright frame to said second upright frame.

3. The cart storage station of claim 2 wherein said first and said second upright frames are co-planar with said first and said second elongate side wall frames, respectively.

4. The storage station of claim 3, wherein at least one of said first and second upright frames has an upper section adapted to mount a sign.

* * * * *